US005611211A

United States Patent [19]

Whipple, III

[11] Patent Number: 5,611,211

[45] Date of Patent: Mar. 18, 1997

[54] REFIRGERATION SYSTEM WITH ELECTRICALLY CONTROLLED REFRIGERANT STORAGE DEVICE

[75] Inventor: Walter Whipple, III, Amsterdam, N.Y.

[73] Assignee: General Electric Company, Schenectady, N.Y.

[21] Appl. No.: 301,763

[22] Filed: Sep. 7, 1994

[51] Int. Cl.[6] ..... F25B 45/00

[52] U.S. Cl. ..... 62/149; 62/209

[58] Field of Search ..... 62/129, 126, 211, 62/223, 149, 174, 209, 208

[56] References Cited

U.S. PATENT DOCUMENTS

| | | | |
|---|---|---|---|
| 2,359,595 | 10/1944 | Urban | 62/149 |
| 2,807,940 | 10/1957 | Urban | 62/149 |
| 4,122,687 | 10/1978 | McKee | 62/156 |
| 4,481,787 | 11/1984 | Lynch | 62/180 |
| 4,509,586 | 4/1985 | Watabe | 62/211 |
| 4,910,972 | 3/1990 | Jaster | 62/335 |
| 4,918,942 | 4/1990 | Jaster | 62/335 |
| 5,103,650 | 4/1992 | Jaster | 62/198 |
| 5,134,859 | 8/1992 | Jaster | 62/503 |

OTHER PUBLICATIONS

Donald E. Knoop et al., "An Adaptive Demand Defrost and Two–Zone Control and Monitor System for Refrigeration Products," IEEE Transactions on Industry Applications, vol. 24, No. 2, Mar./Apr. 1988, pp. 337–342.

"Thermostatic Expansion Valves," Bulletin 10–10, Oct. 1981, Copyright 1981 by Sporlan Valve Co., St. Louis, MO, pp. 1–8.

*Primary Examiner*—John M. Sollecito
*Attorney, Agent, or Firm*—Donald S. Ingraham

[57] ABSTRACT

An energy-efficient refrigeration system includes an electrically controlled refrigerant storage device that is coupled to the refrigeration system to selectively receive refrigerant from and dispense refrigerant to the operating loop of the refrigeration system. The refrigerant storage device includes a storage vessel, means for selectively displacing refrigerant from the storage device into the operating loop, and a refrigerant storage device controller coupled to the means for displacing refrigerant so as to control the mass of refrigerant in the storage vessel in correspondence with the cooling demand on the refrigeration system so that the compressor drive motor is loaded for optimal efficiency for a given cooling demand on the system. The means for displacing refrigerant from the vessel of the storage device typically comprises a temperature control element, such as a heating element or solid state heat pump, that is electrically coupled to the controller and thermally coupled to the vessel. Alternatively, a bladder mechanism is disposed in the vessel for physically varying the volume of the vessel in which refrigerant can be stored in correspondence with signals from the controller.

13 Claims, 1 Drawing Sheet

REFIRGERATION SYSTEM WITH ELECTRICALLY CONTROLLED REFRIGERANT STORAGE DEVICE

BACKGROUND OF THE INVENTION

This invention relates generally to refrigeration systems and in particular to a refrigeration apparatus having an electrically controlled refrigerant storage device to adjust the mass of the refrigerant circulating in the operating loop of the system so as to optimize the operation of the refrigeration apparatus.

Conventional refrigeration systems having moderate capacity (e.g., less than 5 tons) typically include a compressor, a condenser, an evaporator, and a fixed expansion device, such as an orifice or capillary tube. The expansion device is used to introduce a pressure drop in the refrigerant as it passes from the condenser to the evaporator. It is common in refrigeration systems used in refrigerators and small heat pump systems (which typically have a capacity of less than one ton) that the compressor speed and volume are fixed (that is not variable) and the refrigerant charge (that is, the mass of refrigerant circulating through the operating loop of the system) is also fixed. As a consequence, such a system's refrigerant charge can be tuned for most energy-efficient operation for only one set of nominal operating conditions (that is, to meet a given cooling demand); further, in other than that one set of nominal operating conditions the refrigeration apparatus continues to operate but is detuned (that is, one or more components of the system no longer operate at optimal efficiency in conjunction with the other components in the system. One example of a component of the refrigeration apparatus having on optimal point of energy efficient operation is the compressor motor, which typically has one design load that provides the best electrical efficiency for the motor.

The variation in cooling demands placed on the refrigeration apparatus that can effect the optimal operation of system components include changes in ambient conditions and changes in the refrigerator compartment being cooled (e.g., freezer versus fresh food). For example, in conditions of high ambient temperature and humidity coupled with the demand to cool the freezer compartment, the refrigeration apparatus will see a large refrigerant differential temperature between the evaporator and the condenser. Under these conditions the compressor motor can pump refrigerant through the system at a particular mass flow rate. Under less adverse conditions, such as cooler ambient conditions, the compressor motor is pumping refrigerant across a smaller pressure differential (because the temperature differential of the refrigerant through the system is also less) and thus is capable of pumping refrigerant at a higher mass flow rate. In most conventional systems, however, the refrigerant mass is fixed, and thus in operating conditions other than the design (or nominal) conditions, energy will be wasted as the compressor motor will operate at a less efficient point on its efficiency curve.

It is desirable to improve the energy-efficiency of refrigeration systems by enabling them to meet a range of cooling demands and controlling the system to respond to the current cooling demands while operating at near to optimal compressor loads as possible. It is also desirable that an energy saving system be readily fabricated and easily adapted to the refrigeration systems presently manufactured such that the cost of acquiring and operating the system does not exceed the economic benefits of the improved energy efficiency.

It is thus an object of this invention to provide a refrigeration system that improves the energy efficiency of the system through selectively controlling refrigerant mass being used for cooling purposes in the system by use of a controllable and variable refrigerant storage device so as to provide a refrigerant charge that will load the compressor to its optimal energy efficiency in a variety of normal operating environmental conditions and operator set points. Further, such a system for varying refrigerant charge enhances manufacturing flexibility by providing refrigeration apparatus that can readily accomodate normal manufacturing tolerances for components of the refrigeration system (and thus the effect of such variations on the operation of the whole system).

SUMMARY OF THE INVENTION

In accordance with this invention, an energy-efficient refrigeration system includes an electrically controlled refrigerant storage device that is coupled to the refrigeration system to selectively receive refrigerant from and dispense refrigerant to the operating loop of the refrigeration system. The refrigerant storage device includes a storage vessel, means for selectively displacing refrigerant from the storage device into the operating loop, and a refrigerant storage device controller coupled to the means for displacing refrigerant so as to control the mass of refrigerant in the storage vessel in correspondence with the cooling demand. The electrically controlled refrigerant storage device adjusts (that is, increases or decreases) the mass of refrigerant circulating through the operating loop in correspondence with the cooling demand on the refrigeration system so that the compressor drive motor is loaded for optimal efficiency for a given cooling demand on the system.

The refrigerant storage device is typically connected to the operating loop at a connection point disposed between the condenser and the expansion device in the operating loop; the refrigerant flow passes through the expansion device, into the evaporator, into the compressor, and thence back to the condenser. The refrigerant storage device thus typically receives and dispenses liquid refrigerant in the higher pressure portion of the operating loop.

The means for displacing refrigerant from the vessel of the storage device typically comprises a thermal input control element, such as a heating element or solid state heat pump (e.g., a thermoelectric (Peltier effect) device) that is electrically coupled to the controller and thermally coupled to the vessel. Alternatively, a bladder mechanism is disposed in the vessel for physically varying the volume of the vessel in which refrigerant can be stored in correspondence with signals from the controller.

The storage device controller comprises refrigeration system cooling demand sensors to provide input signals corresponding to refrigeration system load (that is, the cooling demand that the system must meet). These input signals are then used to generate corresponding control signals to control the mass of refrigerant circulating in the operating loop by causing refrigerant to be displaced from the storage device (thus increasing the refrigerant mass circulating in the operating loop) or, alternatively, to receive refrigerant from the operating loop, thus reducing the refrigerant mass circulating. The mass of the refrigerant circulating in the loop affects the loading on the compressor in the loop for a given cooling demand. Common cooling demand sensors include, for example, temperature sensors for determining the temperature differential across the evaporator (either circulating air temperature or refrigerant temperature); ambient temperature and humidity conditions, compressor motor output power (e.g., with a phase angle detector or a motor torque sensor), operator set points or selections, or a combination of such sensors.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which:

DETAILED DESCRIPTION OF THE INVENTION

Figure 1:
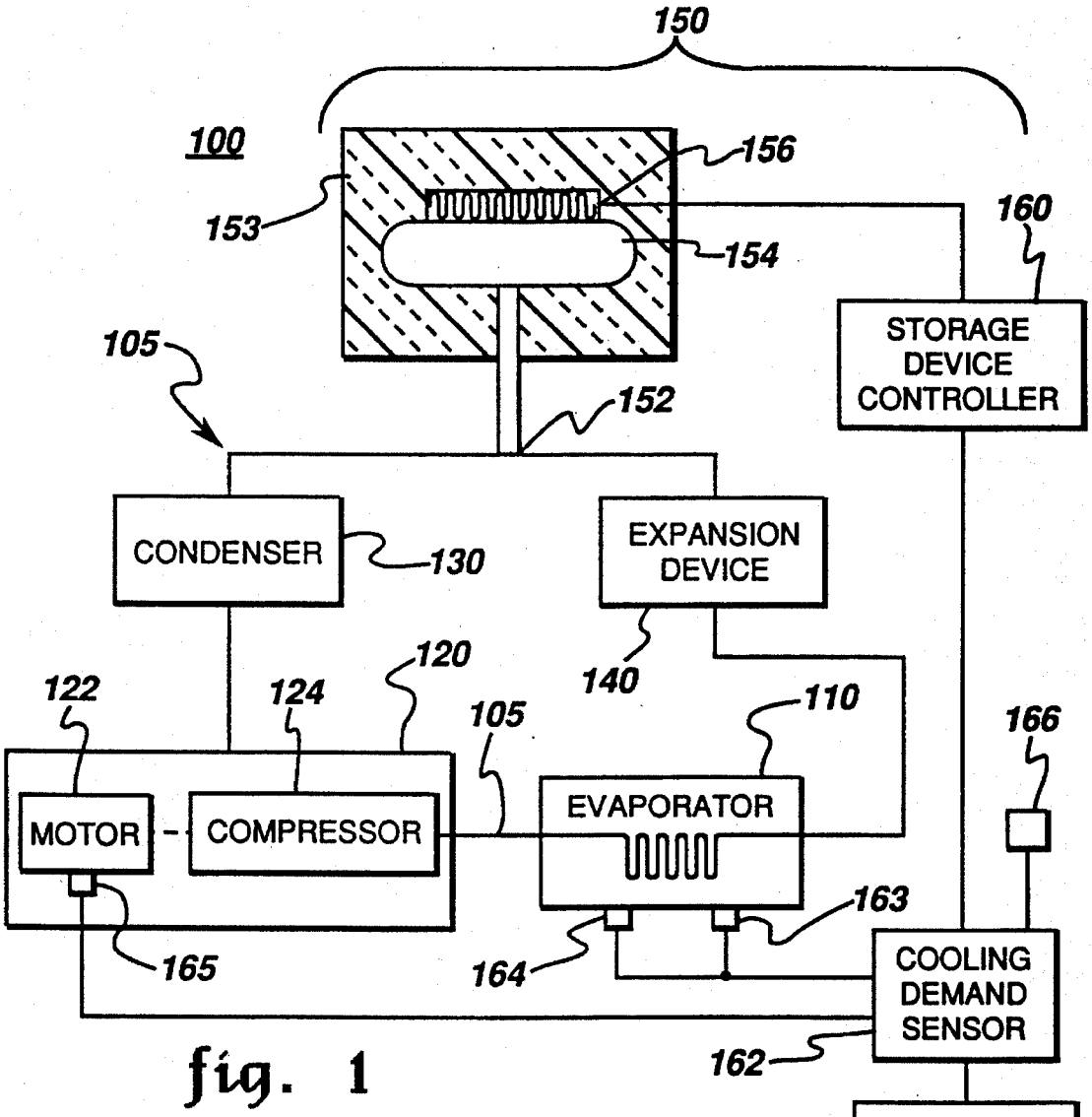
FIG. 1 is a partial schematic and partial block diagram of a refrigeration system having an electrically controlled refrigeration storage device in accordance with one embodiment of this invention.

A refrigeration system 100 (FIG. 1) in accordance with this invention generates chilled air to meet a cooling demand placed on the system, such as in a refrigerator or room air conditioner. Refrigeration system 100 is of a moderate capacity or smaller, that is having a capacity of not more than five tons, and commonly less than 1 ton, e.g., 0.1 ton or the like for consumer appliances such as refrigerators. As used herein, "refrigeration system" refers to devices or combinations of devices that use the phase change of a refrigerant fluid to chill (that is, reduce the temperature of) a cooling-air flow to a temperature sufficiently low so as to meet the cooling demand.

In the present invention, such a refrigeration system typically has an operating loop 105 that comprises an evaporator 110, a compressor 120, a condenser 130, an expansion device 140, all of which are coupled together such that refrigerant compressed by compressor 120 is condensed in condenser 130, passes through expansion device 140 into evaporator 110, in which the refrigerant absorbs heat to chill the cooling air that will pass into the compartments of the refrigerator or the like. Evaporator 110 is coupled to compressor 120 such that the heated (and now-gaseous) refrigerant fluid that enters the compressor is again compressed. Condenser 130 and evaporator 110 are each heat exchangers which transfer energy from and into the refrigerant respectively. The refrigerant fluid is a liquid-to-gas phase changing material adapted for a particular refrigeration system; Freon (referring generally to the group halogenated hydrocarbons (usually based on methane) containing one or more fluorine atoms, and which are commonly used as refrigerants), Freon 134A, Freon 134B propane, butane, combinations thereof, or the like are common examples of refrigerants.

Refrigeration system 100 when used in a refrigerator further comprises means for causing the flow of chilled air to be directed to a particular compartment to meet the cooling demand in that respective compartment. One example of an air-flow control device in a refrigerator that is advantageously used with the electrically controlled expansion valve of the present system is disclosed in co-pending application Ser. No. 08/301,761, entitled "Refrigerator Multiplex Damper System", which is assigned to the assignee herein and incorporated herein by reference. Further, expansion device 140 typically comprises a fixed expansion device such as a capillary tube, orifice or the like, but alternatively may comprise a variable expansion valve such as is disclosed in co-pending application Ser. No. 08/301,762, which is assigned to the assignee herein and incorporated by reference.

In accordance with this invention, refrigeration system 100 further comprises an electrically controlled refrigerant storage device 150 that is coupled to operating loop 105 at a connection point 152 such that storage device 150 can selectively receive system refrigerant from operating loop 105 and selectively dispense system refrigerant into the loop so as to control the mass of refrigerant that is circulating through the operating loop to meet the cooling demand on refrigeration system 100. As used herein, "system refrigerant" refers to the refrigerant that is circulated in refrigeration system 100 so as to chill the cooling air that is used to meet the cooling demands on system 100, that is, the refrigerant that flows between compressor 120, condenser 130, and evaporator 110. Electrically controlled refrigerant storage device 150 further comprises a storage device controller 160 that is electrically coupled to cooling demand sensors 162 so as to generate control signals for storage device 150 in correspondence with the cooling demand on refrigeration system 100.

One embodiment of electrically controlled refrigerant storage device 150 is illustrated in FIG. 1; this device comprises a refrigerant vessel 154 and a vessel thermal input element 156 that is thermally coupled to vessel 154 and provides the means for displacing refrigerant from vessel 154 into operating loop 105. Thermal input element 156 comprises a heating element (such as a resistive strip or the like), a solid state heat pump (such as a themoelectric device (Peltier effect device) or diode heat pump), or the like, that is disposed in thermal contact with vessel 154 such that heat generated when the thermal input element 156 is energized is coupled to vessel 154 (typically by conduction) and results in heating of refrigerant that is contained within vessel 154. Heating of the refrigerant in vessel 154 increases the pressure in the vessel (as some of the refrigerant is boiled) which in turn displaces liquid refrigerant from the vessel through a connection tube and into operating loop 105 at connection point 152.

Figure 2:
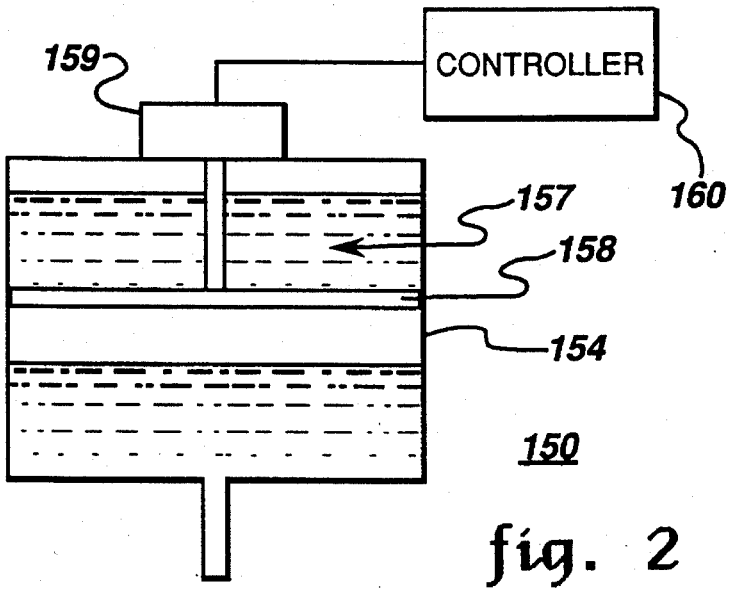
FIG. 2 is a cross-sectional view of a refrigeration storage device in accordance with another embodiment of the present invention.

Alternatively, as illustrated in FIG. 2, refrigerant storage device 150 comprises a bladder mechanism 158 for physically varying the volume of vessel 154 in which refrigerant from operating loop 105 can be disposed. Bladder mechanism comprises a movable surface, such as a piston, which is displaced in correspondence with control signals from controller 160 to vary the effective volume of vessel 154 for storage of the system refrigerant. The motive force for the movable surface comprises a thermal expansion medium 157, such as another refrigerant (or combination of refrigerants), that when heated by a heating element 159 expands and exerts a pressure to displace surface 158. In a further alternative, vessel 154 comprises a flexible structure (not shown) surrounded by a thermal expansion medium, such as an elastomer material such as silicone that is impregnated with a refrigerant material such as Freon (referring generally to the group halogenated hydrocarbons (usually based on methane) containing one or more fluorine atoms, and which are commonly used as refrigerants), Freon 134A, Freon 134B propane, butane, or the like, such that the thermal expansion medium expands (or stretches) and contracts in correspondence with a thermal input to cause corresponding changes in the effective volume of vessel 154.

Vessel 154 (FIG. 1) is typically surrounded by a thermal insulation material 153 and is disposed in refrigerant system 100 in proximity to a heat sink such as evaporator 110 such that, when temperature control element 156 is de-energized, vessel 154 cools towards a temperature at which system refrigerant is a liquid (the pressure in the vessel being essentially the same as that at connection point 152 in operating loop 105). Thus, the pressure within vessel 154 can be controlled by alternatively energizing and de-energizing temperature control element 154 to maintain a desired temperature and pressure of the refrigerant in vessel 154 corresponding to the mass of refrigerant that is desired to be circulating in operating loop 105 for a given cooling demand. The placement of thermal insulation 153 and the proximity of vessel to a heat sink determine one operating characteristic of the system, that is the time necessary for the system to cool and thus receive system refrigerant into the vessel following a heating evolution, and thereby allow displacement of refrigerant from the operating loop 105 into the vessel. Alternatively, thermal input element 156 may comprise a solid state heat pump or the like that is adapted to alternatively heat and cool vessel 154 (selectively in response to signals from controller 160) so as to provide faster response for allowing refrigerant to return to storage vessel 154 following a heating evolution.

In accordance with this invention thermal input element 156 (or alternatively, the thermal element 159 for bladder 158 (FIG. 2)), is electrically coupled to refrigerant storage device controller 160. Controller 160 comprises an analog controller, a digital controller, a microprocessor (also referred to as a micro-controller), or the like and is adapted to generate refrigerant storage device control signals that control the application of energy to temperature control element 156 (FIG. 1), or alternatively, 159 (FIG. 2). Controller 160 further comprises cooling demand sensors 162, such as an evaporator differential temperature sensing device 163 that is coupled to evaporator 110 at positions to determine refrigerant temperature change though the evaporator. Temperature sensor 163 typically comprises a thermocouple, thermistor, a positive temperature coefficient resistor, a negative coefficient temperature resistor, or the like that provides a signal to controller 160 corresponding to the temperature of the system refrigerant flowing through the evaporator. Alternatively, or in addition to refrigerant temperature sensor 163, a cooling air differential temperature sensor 164 is coupled to controller 160 to provide an input signal that corresponds to the cooling demand on refrigeration system 100, such as the refrigerant temperature difference between the inlet and outlet of the evaporator. Controller 160 may comprise a portion of a refrigeration control system such as is disclosed in co-pending application "Energy-Efficient Refrigerator Control System" Ser. No. 08/301,764, which is assigned to the assignee herein and incorporated herein by reference.

By way of example and not limitation, additional inputs to controller 160 corresponding to cooling demand on refrigeration system 100 comprise an ambient condition sensor 166, such as a temperature and humidity sensor, and an operator set point circuit 167 by which the system operator selects desired temperatures. Additionally, a compressor drive motor load sensing circuit 165 is coupled to a drive motor 122 that drives compressor device 124 in which the system refrigerant circulating through operating loop 105 is compressed. Motor load sensing circuit 165 comprises, for example, a motor power, motor torque, or motor phase angle sensor such as is disclosed in U.S. Pat. No. 5,319,304, entitled "Device For Monitoring Load", which is assigned to the assignee herein and incorporated by reference.

For optimal efficiency of refrigeration system 100 it is desirable that compressor drive motor be loaded to operate as close a possible to the point of optimal electrical efficiency (the motor being designed for optimal electrical efficiency at some point, typically for operation at its rated maximum output power level, as opposed to watts consumed). The work produced by compressor motor 122 is a function of the pressure differential across the compressor, the refrigerant mass flow rate, and the additional heat of compression of the refrigerant in the compressor. For example, at a high pressure differential, such as when refrigeration system 100 is being used to cool a freezer compartment to its lowest user setting in ambient conditions of high temperature and humidity, the compressor motor will produce its maximum output at one selected refrigerant mass flow rate. In different operating conditions, such as in less severe ambient conditions or cooling a different compartment in the freezer, the refrigerant flow rate to obtain compressor loading for optimal efficiency will be different, and the refrigeration system can be tuned for optimal performance by adjusting the refrigerant charge in the operating loop with appropriate control of storage device 150. A system without any means of changing the refrigerant charge in the operating loop is not able to adjust to other than nominal (design) conditions without the loss of energy efficiency in the combined operation of components in the refrigeration system. Thus, for example, the compressor motor will operate at a lower electrical efficiency when the refrigeration system is called upon to meet a cooling demand other than the nominal demand the system is designed to meet.

In operation, controller 160 senses cooling demand on refrigeration system and generates a control signal for storage device 150 to adjust the mass of refrigerant circulating in operating loop 105 to place sufficient load on compressor motor 122 to optimize its electrical efficiency. Thus, when cooling demand requires a reduced refrigerant charge circulating in the operating loop, thermal input control element is controlled to allow refrigerant in vessel 154 to cool, reducing the pressure in the vessel and allowing liquid refrigerant to enter the vessel from the operating loop, while maintaining sufficient refrigerant circulating in the loop to allow compressor motor 122 to operate near its optimal efficiency. When refrigeration system 100 operates to meet a different cooling demand in which optimal system efficiency is obtained with increased refrigerant charge circulating in the operating loop, temperature control element 156 is operated to heat the refrigerant in vessel 154, thereby increasing the pressure in the vessel and displacing refrigerant into operating loop 105. Refrigerant of sufficient mass is added to operating loop to increase the mass flow rate to load compressor motor 122 to obtain improved electrical efficiency from the motor.

While only certain features of the invention have been illustrated and described herein, many modification and changes will occur to those skilled in the art. It is, therefore, to be understood that the appended claims are intended to cover all such modifications and changes as fall within the true spirit of the invention.

What is claimed is:

1. A refrigeration system having enhanced energy efficiency, comprising:

a refrigerant compressor disposed in an operating loop of said refrigeration system, said compressor having a drive motor;

a condenser coupled to said compressor to receive compressed refrigerant therefrom;

an evaporator coupled to said condenser to receive condensed and compressed refrigerant therefrom, said evaporator being further coupled to said compressor; and an electrically controlled refrigerant storage device coupled to said refrigerant system at a connection point so as to selectively receive refrigerant from and dispense refrigerant to said operating loop of said refrigeration system, said connection point of said refrigerant storage device being disposed to receive said condensed and compressed refrigerant passing from said condenser;

said electrically controlled refrigerant storage device comprising:

a storage vessel;

a refrigerant storage device electronic controller, said controller further comprising a cooling demand sensor coupled to a plurality of temperature sensors disposed on said evaporator so as to provide respective temperature signals corresponding to the temperature of fluid flowing across said evaporator, said storage device electronic controller being coupled to said means for displacing refrigerant to provide a control signal thereto responsive to a sensed fluid-flow temperature differential across said evaporator and to a sensed compressor drive motor electrical load so as to control the mass of refrigerant stored in said storage vessel in correspondence with the sensed fluid flow temperature differential across said evaporator and the sensed compressor drive motor electrical load, the mass of refrigerant stored in said storage vessel corresponding to a pressure differential between the refrigerant in said vessel and the refrigerant at the connection point in said refrigeration system; and a thermal input control element thermally coupled to said vessel and electrically coupled to said storage device electronic controller;

whereby the refrigerant charge in said operating loop is adjusted in correspondence and with the sensed fluid flow temperature differential across the evaporator and the sensed compressor drive motor electrical load so as to maintain the compressor drive motor loaded for optimal efficiency to meet the cooling demand.

2. The refrigeration system of claim 1 wherein said vessel thermal input control element comprises a heating element.

3. The refrigeration system of claim 1 wherein said vessel thermal input control element comprises a solid state heat pump element adapted to alternatively heat or cool the refrigerant in said vessel in correspondence with signals generated by said controller.

4. The refrigeration system of claim 1 wherein said means for selectively displacing refrigerant comprises a bladder mechanism for physically varying the volume said vessel in which said refrigerant can be disposed.

5. The refrigeration system of claim 4 wherein said bladder mechanism further comprises a thermal expansion medium thermally coupled to a thermal input element.

6. The refrigeration system of claim 5 wherein said thermal expansion medium comprises an elastomer material impregnated with a refrigerant material.

7. The refrigeration system of claim 1 wherein said cooling demand sensor is coupled to a plurality of temperature sensors disposed on said evaporator so as to sense the temperature differential of cooling air flowing over said evaporator.

8. The refrigeration system of claim 1 wherein said cooling demand sensor is coupled to a plurality of temperature sensors disposed on said evaporator so as to sense the temperature differential of refrigerant flowing through said evaporator.

9. The refrigeration system of claim 1 wherein said cooling demand sensor further comprises an ambient temperature sensor.

10. The refrigeration system of claim 1 wherein said cooling demand sensor further comprises an operator set point circuit.

11. The refrigeration system of claim 1 wherein said cooling demand sensor further comprises a drive motor load sensing circuit coupled to said compressor drive motor.

12. The refrigeration system of claim 1 wherein the capacity of said refrigeration system is not greater than five tons.

13. The refrigeration system of claim 12 wherein the capacity of said refrigeration system is in the range between about 0.1 ton and 1 ton.

* * * * *